US005544517A

United States Patent [19]

Shimizu

[11] Patent Number: 5,544,517

[45] Date of Patent: Aug. 13, 1996

[54] METHOD OF REDRAWING A PREDRAWN COATED METAL CAN

[75] Inventor: Keiichi Shimizu, Hikari, Japan

[73] Assignee: Toyo Kohan Co., Ltd., Tokyo, Japan

[21] Appl. No.: 301,852

[22] Filed: Sep. 7, 1994

[30] Foreign Application Priority Data

Dec. 22, 1993 [JP] Japan ..... 5-345629

[51] Int. Cl.[6] ..... B21D 22/00

[52] U.S. Cl. ..... 72/349; 72/347; 72/350; 72/379.4

[58] Field of Search ..... 72/347, 349, 350, 72/379.4

[56] References Cited

U.S. PATENT DOCUMENTS

| | | | |
|---|---|---|---|
| 4,425,778 | 1/1984 | Franek et al. | 72/347 |
| 5,105,645 | 4/1992 | Kobayashi et al. | 72/379.4 |
| 5,179,854 | 1/1993 | Matsui et al. | 72/349 |
| 5,249,447 | 10/1993 | Aizawa et al. | 72/349 |
| 5,333,484 | 8/1994 | Mine et al. | 72/349 |

OTHER PUBLICATIONS

Tool Engineer's Handbook, Ironing & Redrawing (1949) example, p. 1528, American Society of Tool Engineer's.

*Primary Examiner*—Daniel C. Crane
*Assistant Examiner*—Ed Tolan
*Attorney, Agent, or Firm*—Felfe & Lynch

[57] ABSTRACT

A predrawn can made of a metal sheet coated with an organic film is subjected to a process which reduces its diameter and thins its walls by a high thinning ratio. The thinning is achieved by a blank holder (1), a redrawing die (3) and an ironing die (4), the reduction ratio for the ironing die being defined by $$\frac{(T_2 - T_3)}{T_2} \times 100\%$$

wherein $T_2$ equals the thickness of the can before ironing and $T_3$ equals the thickness after ironing, wherein the reduction ratio for the ironing die is in the range of 10 to 50%. The wall at the top end portion of the can is maintained thicker than the rest of the can wall.

10 Claims, 2 Drawing Sheets

METHOD OF REDRAWING A PREDRAWN COATED METAL CAN

BACKGROUND OF THE INVENTION

The present invention relates to a method of redrawing a predrawn coated metal can with organic film.

Conventional methods of can forming are to draw and redraw (drawn-and-redrawn "DRD" can) or draw and iron (drawn-and-ironed "DI" can) two piece cans in which the sides and base are integrated. In addition to these, a drawn-thin/redrawn can ("DTR" can) is known. Since the DRD can is formed by drawing and redrawing, the wall thickness of the can is thick in proportion to the height of the can. For this reason, the DRD technique is generally used to make low height cans in consideration of cost effectiveness. The thickness of a DI can formed by ironing subsequent to the process of drawing is usually about one third of the starting wall thickness and therefore, these cans can economically be used in applications where the can is of relatively high height.

As a comparison between the DRD and DI cans, the former is drawn from a metal sheet initially coated with an organic film, while the latter is coated with an organic film after the ironing process. This results from the fact that the degree of processing and the stress intensities generated by the two different methods of processing are substantially different. If an organic film is applied to the metal sheet before processing of a DI can, which is subject to a much higher reduction ratio and thus the application of a much higher applied surface pressure, there may be damage of inner and outer organic films and jamming of the die with the organic material of the films. This tends to make this method of processing unsatisfactory.

The DTR can is formed by using a redrawing die with a smaller shoulder radius. Bending and bending back of the can wall are performed at this shoulder by applying a high tension to thin the wall thickness of the can. In the DTR method, the can wall is stretched by a process very similar to drawing, and again the wall thickness is made a little thinner than the starting thickness because the can wall is stretched during the process. Moreover, as the surface pressure applied on the can wall between the die and the punch is not so high, the load on the organic film is also not so high and therefore, damage of the organic film is unlikely. This makes it preferable to apply the organic film to the metal sheet prior to processing. However, the processing for the DTR can is based substantially on a tension force, which has a tendency to cause defects in or fractures of the wall, and so there is a disadvantage that the reduction ratio which can be reliably achieved is much smaller than in the case of a DI can.

As mentioned above, the DRD, DI and DTR cans have respective characteristics, although they each have particular problems. One of the objects of at least the preferred embodiments of the present invention is to provide a method of reducing the wall thickness of a predrawn can made from a metal sheet having a coating of organic film, with a high reduction ratio, by completing the processes of redrawing, stretching and ironing under certain conditions. There is thus disclosed herein a technique of can processing for forming a can which will have characteristics of both the DI and the DTR cans.

A known DTR can processing technique is disclosed in GB-A-2216052. Another known technique incorporating stretching and a small amount of ironing carried out at the same time as redrawing, is disclosed in GB-A-2061790. The technique of GB-A-2061790 requires the ironing process to be lightly performed with an aim of just obtaining a uniform wall thickness, where the reduction ratio depends upon a ratio of wall thickness to radius of die shoulder, that is, the required thinning of the can is executed by the DTR process. For this reason, the technique of GB-A-2061790 does not provide a high reduction ratio. It is directed towards the thickness of the can wall being made uniform throughout its height, and the end portion of the can wall remains to be flanged in the redrawing process, without being drawn.

Ideally, to reduce costs, the shell of a can should be thinned as much as possible and the top end portion of the shell should be thicker for subsequent neck-in processing (reduction of the diameter of the can at the end portion). The technique of GB-A-2061790 does not achieve this. According to the disclosure, if the can wall is thinned for weight reduction purposes, then it will be difficult to accomplish the subsequent neck-in processing successfully since the can wall is made uniform in thickness throughout its height. If, on the other hand, the can wall is made thicker in consideration of neck-in processing, then the benefits of weight reduction will be lost. Hence, the relationship between formability and weight reduction have to be offset against each other.

Thus, to summarise the prior art, the DI can processing is the most typical method of manufacturing a two-piece can having a relatively high can height, and is capable of thinning the can wall with a high ratio. However, it is difficult to apply an organic film coating to the metal sheet prior to processing because of possible damage to the film. With regard to DTR can processing, it is possible to apply an organic film to the metal sheet prior to processing, but it is difficult to thin the can wall to a high ratio.

SUMMARY OF THE INVENTION

Viewed from one aspect the invention provides a method of redrawing a predrawn coated metal can in a tool comprising a blank holder, a redrawing die and an ironing die, the reduction ratio for the ironing die being defined by $$\frac{(T_2 - T_3)}{T_2} \times 100\%$$

wherein $T_2$ equals the thickness of the can before ironing and $T_3$ equals the thickness after ironing, wherein the reduction ratio for the ironing die is in the range of 10 to 50%.

In preferred embodiments of the present invention the surface of the tool, in a region between the shoulder of the redrawing die and the ironing portion of the ironing die, is not in contact with the outer surface of the can. Preferably the radius $R_1$ of the shoulder of the blank holder and the radius $R_2$ of the shoulder of the redrawing die are in the ratio of 4 to 20 times and 1.2 to 15 times a thickness $T_0$ respectively, where $T_0$ is the thickness of the blank used to form the predrawn metal can, and more preferably the radii $R_1$ and $R_2$ are in the ratio of 4 to 10 times and 1.5 to 8 times the thickness $T_0$ respectively. The gross reduction ratio given by the equation $$\frac{(T_0 - T_3)}{T_0} \times 100\%$$

is preferably in the range of 20 to 60%.

The coating on the metal blank is an organic coating, on both sides of the can. A suitable coated blank is disclosed in U.S. application Ser. No. 08/301,844 filed concurrently herewith. Use of such a blank in the present method permits dry forming without damage to the coating. Of course, the method can easily be used for forming with coolant.

Preferably the top end portion of the can wall remains thicker than the remainder of the can wall. In preferred embodiments, after redrawing, the can is trimmed to leave the top portion of the can which is before ironing die 4. By providing such a thicker top portion, reliable neck-in processing is facilitated. This top portion, prior to the neck-in processing, is preferably in an offset condition at an angle of not more than 7 degrees from the remainder of the can wall.

With preferred embodiments, it is feasible to reduce the diameter of a predrawn can made of a metal sheet that has been coated with an organic film by a redrawing ratio of 1.15 to 1.4 (can diameter before redrawing/can diameter after redrawing), by moving the redrawing punch forward into the can which is disposed between an annular blank holder and the redrawing die. At the shoulder of the redrawing die, the wall thickness is maintained relatively thick, for example to be thinned by no more than 20% of the starting thickness. The wall is then further thinned by an ironing die disposed immediately after the redrawing die, with the ironing die performing a substantial part of the thinning, giving the preferred gross reduction ratio of 20 to 60%. Preferably the clearance $C_1$ between the redrawing die and the punch is in the range of 0.8 to 1.4 times of the starting thickness $T_0$ (which is not significantly different from $T_1$) of the can. The length between the top of the redrawing die and the ironing portion of the ironing die is preferably in the range of 10 to 30 mm.

The preferred embodiments of the present invention can thus provide a method for redrawing a predrawn can, which is lightweight and can subsequently withstand neck-in processing, originally formed from a metal sheet coated with an organic film.

DETAILED DESCRIPTION OF THE PREFERRED EMBODIMENT

Figure 1:
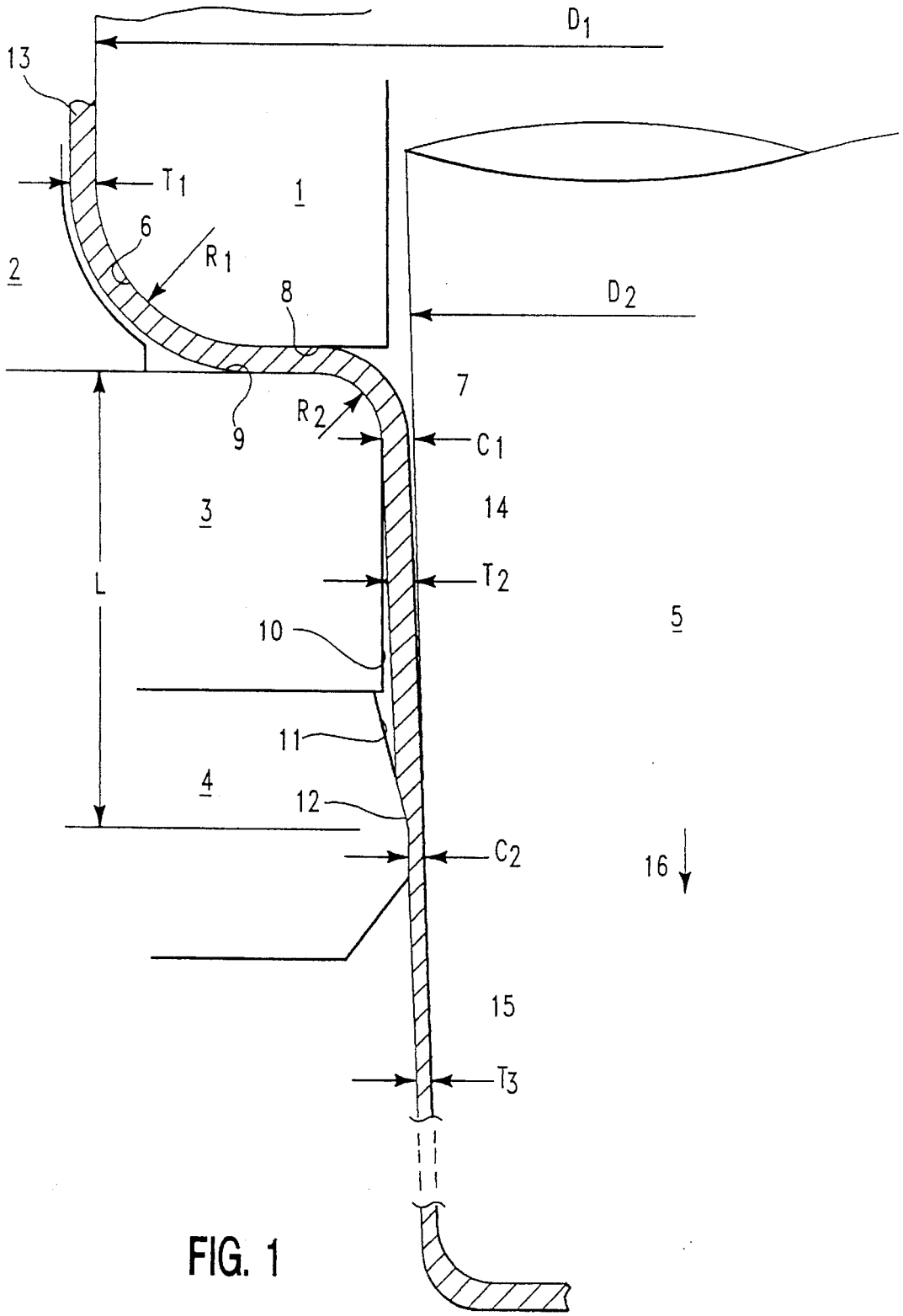
FIG. 1 shows a sectional elevation of a preferred tool arrangement of the present invention.
Figure 3:
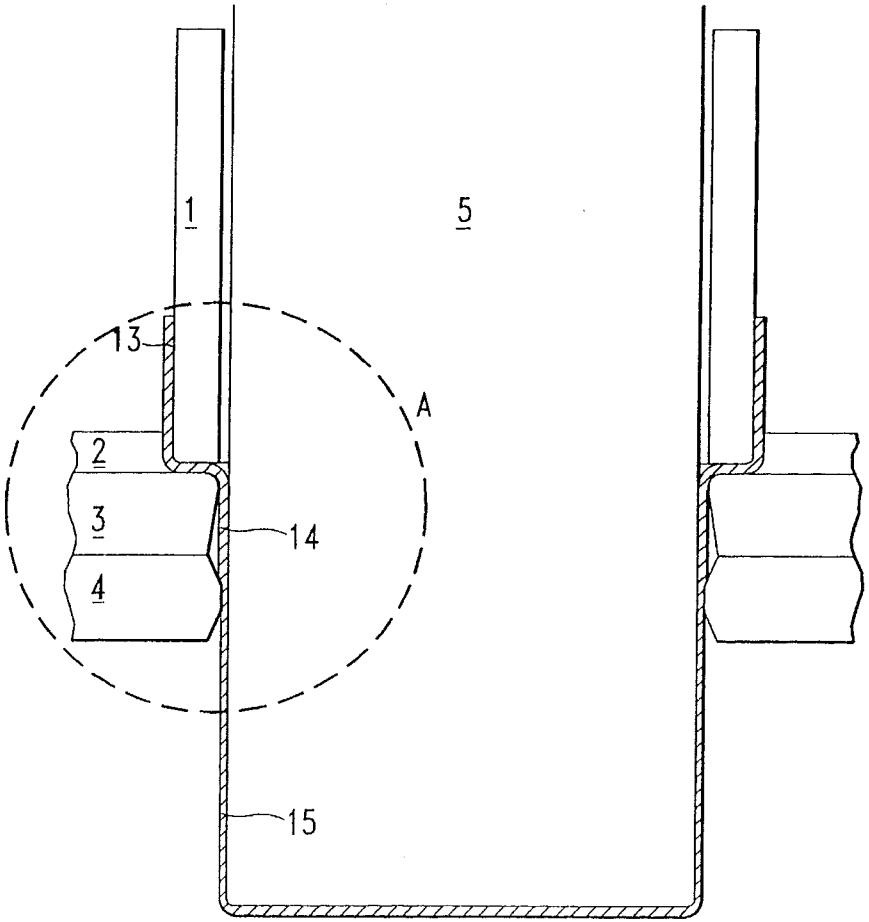
FIG. 3 shows a sectional elevation of the arrangement of FIG. 2 during the process of redrawing.
Figure 2:
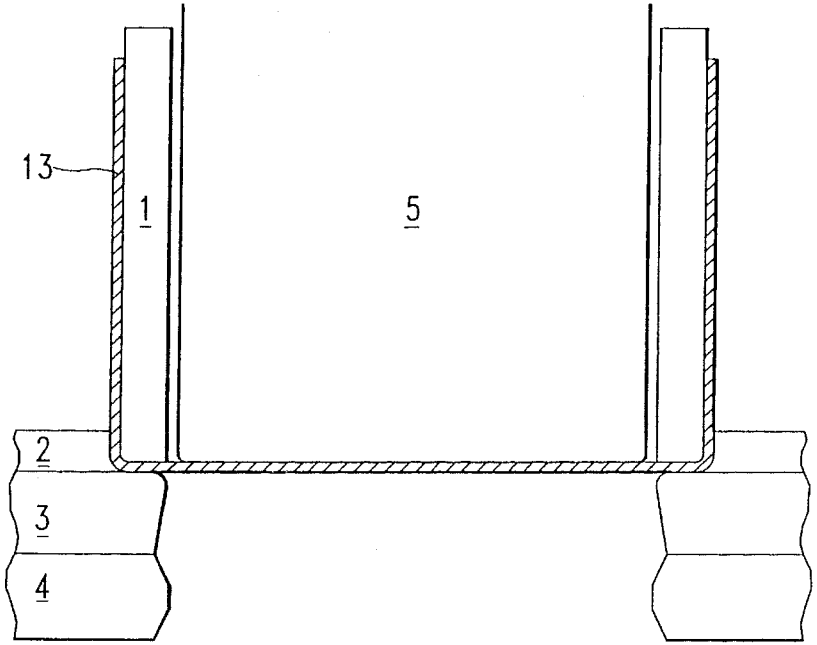
FIG. 2 shows a sectional elevation of the preferred arrangement before the predrawn can is redrawn.

A preferred redrawing method according to the present invention will be described with reference to FIG. 1, which is an enlarged view of A in FIG. 3. Initially, a predrawn can 13, which has been predrawn from a metal sheet coated with an organic film, is held under pressure by a redrawing die 3 and a blank holder 1. A guide ring 2 is provided outwardly of the blank holder 1. Then a punch 5 is moved forward, in the direction indicated by the arrow at 16, to form a can wall 14 having a smaller diameter. The can wall is then ironed by an ironing die 4 thinning the wall to form wall 15 as the punch 5 moves forward in the direction of arrow 16. The wall reduction ratio through tension and bending at a shoulder 7 of the redrawing die is in a range of about −5 to +20% (−5% reduction ratio means an increase in wall thickness by 5%; in the drawing process the wall thickness is increased in proportion to the drawing ratio, and it means herein that an increase in wall thickness is restricted to be about 5% maximum). The reduction ratio for ironing, given by $(T_2-T_3)\times100/T_2$, is in a range of 10 to 50%, where $T_2$ is the thickness of the can wall 14 before ironing, and $T_3$ is the thickness of the can wall 15 after ironing. Then, a gross reduction ratio is given by $(T_1-T_3)\times100/T_1$, wherein $T_1$ is the wall thickness of a predrawn can at a half of its height. However, the thickness $T_1$ of a predrawn can can vary with the location on the can in a circumferential direction, and therefore the gross reduction ratio cannot be determined directly. This being the case, the gross reduction ratio is taken as $(T_0-T_3)\times100/T_0$, where $T_0$ is the starting thickness subject to little thickness variation and not significantly different from $T_1$, and the gross reduction ratio is in a range of 20 to 60%. Considering the relationship between the reduction ratio for the redrawing die at the shoulder 7 and the reduction ratio for the ironing die 4, when the former is close to the upper limit, it is more appropriate for latter to have a smaller value, if concerned with wall fracture. If the above gross reduction ratio is in a range of 20 to 60%, the clearance $C_2$ between the ironing die 4 and the punch 5 should appropriately be in a range of $0.8\times T_0$ to $0.3\times T_0$.

The reason why the diameter of a predrawn can made from a metal sheet coated with an organic film can be reduced and yet the wall thickness of this can can be thinned in a high thinning ratio in the preferred embodiments will be described as follows. Possible difficulties that can arise when reducing the diameter of a predrawn can and the wall thickness of that can in a high ratio include fractures in the wall 14 or 15, and damage to the inner and outer surfaces of the can, particularly to any organic film coating that might be present on the external surface. It is quite possible that damage to the organic film can be the cause of fracture in the wall. The factors that contribute to organic film damage, such as cracks in the wall and longitudinal scratches, are complex and involve at least the redrawing ratio, the corner radius $R_1$ of blank holder 1, the pressurizing force between the top surface 9 of the redrawing die 3 and the bottom surface 8 of blank holder 1, the corner radius $R_2$ of the redrawing die 3, the roughness of the surfaces 8 and 9, the profile of the ironing die 4, clearance $C_2$ between the ironing die and the punch, and so on. The surface 8 and 9 are finished to a mirror surface with roughness below 1 micron in order to prevent damage to the organic coating. The method according to the preferred embodiments of the present invention could only be derived based on the results of a numerous variety of experiments focused on the above factors.

Preferred features of the present invention which are concerned with the prevention of wall fracture and damage to the organic film will now be described. The problem of wall fracture was thought to be caused at the can walls 14 and 15 because a higher tension was being applied to these walls than their tensile strength. It was also presumed that the damage to the organic film was due to an excessive surface pressure applied to the wall between the redrawing die 3 and the punch 5 or between the ironing die 4 and the punch 5. Hence, repeated studies were done to determine the optimum values of the above mentioned tension and surface pressures to resolve these difficulties.

Factors attributable to the tension applied to the can walls 14 and 15 include the redrawing load (a combination of the bending and bending back at the corner radius 6 of the blank holder, the material deformation and the friction force between the surface 8 of the blank holder and the top 9 of the redrawing die, and the bending and bending back at the shoulder 7 of the redrawing die), the ironing force and the friction force applied to the inner and outer surfaces of the can wall. The location of any resulting fracture depends upon the processing conditions, e.g. if the redrawing load is very high, the can will fracture at the can wall 14 before the can starts to be ironed. Conversely, when the can is being thinned by ironing with a high thinning ratio, cracking in the wall will occur at the part to be ironed in almost all cases, and therefore it is essential to have a tension lower than the breaking force. Now, damage to the organic film tends to occur at an external wall surface during ironing, but the higher the above tension is, the less the damage to the organic film tends to occur, and thus the effects of tension on the organic film damage and the wall fracture are reciprocal. Since tension contributes to the deformation of material on the ironing die, the higher the tension, the lower the pressure that is applied on the can wall surface by the die 4 and the punch 5, with the result that the organic film is probably less damaged. Hence, the tension to be applied to the material being subjected to ironing should be lower than the breaking strength but also should be as high as possible to give the best results.

If the radius $R_1$ of the blank holder's shoulder and radius $R_2$ of the redrawing die's shoulder are small, the redrawing load becomes high, which results in an increase in the tension in the can wall and, in turn, increase the likelihood of cracks forming in the wall. On the contrary, if the radius $R_1$ of blank holder's shoulder and the radius $R_2$ of the redrawing die's shoulder are large, the redrawing load can be reduced, in which case, however, there are some disadvantages, e.g. wrinkles formed at the can wall, or the ironing load becoming greater because of an increase in wall thickness according to the redrawing ratio, or insufficient effect of reducing the surface pressure at the ironing die due to a lower tension in the can wall. Therefore, the radius $R_1$ of the blank holder's shoulder and the radius $R_2$ of the redrawing die's shoulder should preferably be between upper and lower limits, which can be determined in relation to the starting thickness $T_0$. Alternatively, $R_1$ and $R_2$ can be determined in relation to the thickness $T_1$ of wall 13 before redrawing, but such wall thickness will vary with location depending on height and position in the circumferential direction. For this reason, for the purpose of providing a clearer definition of the relationship, the above radii are determined based on the starting thickness $T_0$. Yet, $T_0$ is not significantly different from $T_1$.

Moreover, frictional forces experienced by the inner and outer surfaces of the can wall are also important factors. The frictional force experienced by the outer surface tends to cause problems such as damage to the organic film on the outer surface, an increase in tension on the can wall at the part to be ironed, or a fracture of the wall, without being part of the redrawing load nor contributing in any way to the redrawing process.

Therefore, it is important that the outer surface of the can wall 14 does not contact hard with the surface 10 of the redrawing die and the surface 11 of the ironing die. The extent of the contact between these surfaces should be restricted to two thirds, preferably one third, of the applicable length, and even if these surfaces come in contact with each other, the contact should not be strong or tight. Also, the frictional force between the internal surface of the can wall and the punch can transfer part of the redrawing load, but does so without increasing the tension in the can wall. Hence, it is preferable that this frictional force is put into use. The reason why the clearance $C_1$ between the redrawing die 3 and the punch 5 is determined to be related to the thickness is that frictional force is applied between the inner surface of the can wall 14 and the punch 5. The smaller the clearance $C_1$, the higher will be this frictional force, which is of advantage in terms of the contribution to the redrawing load. However, if the clearance $C_1$ is small, the surface pressure on the can wall from the redrawing die 3 and the punch 5 is increased and may allow damage to occur to the organic film. If the clearance $C_1$ is large, the contact between the inner surface of the can wall and the punch 5 is lessened and the benefit of the frictional force is lost. Therefore, it is preferable for $C_1$ to range from 0.8 to 1.4 times of $T_0$ ($T_0$ is used instead of $T_1$ by the reason mentioned above). After the redrawing process, a can may be withdrawn by moving the punch 5 back providing that the rear end portion of the can still remains on the top 9 of redrawing die, and then the can wall 14 of the redrawn can be subsequently trimmed at a location close to the shoulder 7 of the die. This means that almost the whole of the can wall 14 becomes the top end portion of a final can product.

This top end portion is then subjected to neck-in processing for reducing the bore as well as flanging for seaming, so that it is reasonable to say that not only a greater thickness of can wall 14 but also a smaller angle of the can wall 14 to the can wall 15 is more preferable. If the clearance $C_1$ is large, the angle of the can wall 14 to the can wall 15 is made large as well, so that the bore of the can wall closer to the top end portion is enlarged to form a so-called bell shape, which makes it more difficult to neck-in thereafter. In order to overcome the above problems, limitations to the clearance $C_1$ should preferably be adhered to, for example by providing a positive angle of less than 7 degrees between a line connecting the redrawing die shoulder 7 with the part to be ironed at a minimum bore to an axis of the punch 5. For this reason, the upper and lower limits of the clearance $C_1$ and the angle of the redrawing die shoulder to the portion to be ironed were determined.

Next, the determination of the reduction ratio for ironing to be performed at the can wall 14 following redrawing will be described. According to preferred embodiments of the present invention, the gross reduction ratio, i.e. the reduction ratio of the can wall thickness $T_3$ after ironing to the starting thickness $T_0$ of a metal sheet is between a range of 20 to 60%, and the substantial thinning is done at the ironing stage.

In this respect, selection of the gross reduction ratio of 20 to 60% is based upon the shape and the contents of the can (eg. internal pressure, contents to be charged, type of sterilization, etc.), and a material will have to be selected accordingly bearing in mind the required reduction ratio. Selection of a reduction ratio above 10% is preferred because the thickness of the can wall 15 is expected to be uniform and the thickness of the can wall 14 at the end portion will ultimately need to be thicker with a view to the neck in processing (reducing the diameter of the top end portion of the can) and the flanging (flange-forming of the top end portion). That is, the can wall 15 is made thinner, while the can wall 14 at the end portion is intended to be thicker. Also, the reason for selecting a reduction ratio below 50% is because over 50% fracture of the wall is likely to occur and the stability of the finished can quality will decrease because of the narrow region which provides both the tension and the surface pressure at the region to be ironed.

So far, the reason for limiting the reduction ratio has been described. In this respect, however, to achieve the overall mean reduction ratio, the larger the reduction ratio for the redrawing die shoulder, the lower the limitation of the reduction ratio must be for the ironing die, and conversely the smaller the reduction ratio for the redrawing die shoulder, the higher the limitation of reduction ratio must be for the ironing die. The optimum values of reduction ratio for the redrawing die shoulder and the ironing die depend upon the materlal and the processing conditions, but a repeatability of processing with minimum breakage or problems is preferably assured by having a small reduction ratio for the redrawing die shoulder and a large reduction ratio for the ironing die.

According to a preferred embodiment of the present invention, the length between the top 9 of the redrawing die and the edge of the part to be ironed, i.e. the length of top end portion of a can product, is 10 to 30 mm, and this length is ideal for the neck-in processing to be performed after the can wall has been completely formed. To save expenditure, it is preferred to make the can wall as thin as possible, although it is important that the top end portion of the can is made thick enough to allow it to be necked-in to smaller diameter than that of shell and seamed.

The can wall 14 is thickened in contrast to the can wall 15 to a predetermined extent between the top 9 of the redrawing die and the part to be ironed, and which part of the can wall 14 is positioned with respect to the can wall 15 substantially in alignment, without a substantial angle therebetween, with the intention solely to produce a redrawn can that is lightweight and allows the neck-in process to be properly applied.

There are a number of choices of material for the metal sheet substrate upon which an organic film can be coated. Examples are electrolytic chromate filmed steel sheet, aluminium alloy sheet (Al-Mn or Al-Mg base), chemical conversion treated aluminium alloy sheet, or electrolytic chromate filmed tin sheet, selected as appropriate depending on the requirements. Also, as for the organic film coating, for the inside of the can the film may be selected from polyester resin, phenol epoxy resin, epoxy acrylic resin, and polyester amino resin, according to the degree and conditions of processing and the type of substrate. For the outside of the can, the material may be chosen from a polyester resin film, or a lubricant film eg. a resin containing fluorine, polyolefine wax or natural wax added to polyester resin, vinyl resin, phenol epoxy resin or phenoxy resin, or a composite film comprising a top coat of the foregoing lubricant film and an under coat made of polyester resin or phenol epoxy resin, according also to the degree and conditions of processing and the type of substrate.

Hereinafter particular embodiments of the present invention will be described.

Embodiment 1.

To both sides of a substrate made of an electrolytic chromate filmed steel sheet (TFS) of temper DR-8 and thickness 0.18 mm, a biaxial oriented polyethylene telephthalate film is thermally laminated in a thickness of 20μm to coat the metal sheet with the organic film. Wax is applied to this organic film coated metal sheet, and the sheet is then punched into a disc with diameter 170 mm. From this a lightly drawn can with a diameter of 103 mm is formed by a drawing ratio of 1.36 to 1.65. The drawn can is then subject to a primary stage of redrawing with a redrawing ratio of 1.25, by using a blank holder whose shoulder's radius is 2 mm, and a redrawing die whose shoulder's radius is 1.6 mm. This redrawn can had a diameter of 82.4 mm. Using this redrawn can as a predrawn can, reduction of the can diameter and thinning of the wall were conducted under the conditions illustrated in Table 1, which shows examples of the present invention and also comparative reference examples. In all cases, the diameter was reduced by a redrawing ratio of 1.25. In FIG. 1 this corresponds to $D_1$=82.4 mm and $D_2$=66 mm. The results were evaluated with respect to such features as limiting ironing ratio, limiting gross reduction ratio (maximum reduction ratio without wall fracture), damaging of organic film on both sides of the can, and neck-in workability. The length L was 20 and 5 mm, and the effect of this length was evaluated based on the neck-in workability. In the Table, the words "yes", "half" and "no" in the column of "Contact of Can Wall 14" mean that the can wall 14 contacts with the side wall 10 of redrawing die and the side wall 11 of the ironing die for the area of: "one half of the full relevant surface or more" for "yes", "less than one fifth of the full relevant surface" for "no" and "from one fifth to one half of the full relevant surface" for "half". Damage to the film coated on the outer surface of the can was evaluated visually, and the damage to the film on the inner surface was calculated from the exposure of the metal skin (ERV: enamel rater value).

Embodiment 2

To both sides of an aluminium alloy sheet substrate of Al-Mn base of thickness 0.25 mm, a biaxially oriented polyethylene telephthalate film of thickness 20 μm is thermally bonded to the metal sheet. A redrawn can was made by using the same mould as Embodiment 1 for both drawing .and the primary stage of redrawing. Using this redrawn can as a predrawn can, the processing characteristics were evaluated for conditions given in Table 2 in the same way as Embodiment 1. As apparent from these tables, it is proven that the preferred methods of forming according to the present invention can accomplish not only the reduction of the can wall in a high reduction ratio thereby reducing the can diameter, but also this is done without damaging the organic film on the inner and outer surfaces of the metal sheet forming the can.

TABLE 1

| Embodiment | 1 | | | | | | | | | |
|---|---|---|---|---|---|---|---|---|---|---|
| Kinds of metal sheet | Thickness 0.18 mm TFS | | | | | | | | | |
| $R_1/T_0$ ratio | 6 | 6 | 6 | 6 | 6 | 6 | 10 | 6 | 6 | 25 |
| $R_2/T_0$ ratio | 2 | 2 | 2 | 1 | 2 | 2 | 2 | 10 | 20 | 10 |
| *1 Contact of can wall 14 | half | half | half | half | yes | no | no | no | no | no |
| $C_1/T_0$ ratio | 1.4 | 1.4 | 1.4 | 1.4 | 0.9 | 0.9 | 1.4 | 1.4 | 1.4 | 1.4 |
| Length L mm | 20 | 5 | — | 20 | 5 | 20 | 20 | 20 | 20 | 20 |
| Ironing | executed | executed | no | executed | executed | executed | executed | executed | executed | executed |
| *2 Limiting ironing ratio (%) | 25 | 25 | — | 9 | 25 | 30 | 25 | 20 | 25 | 25 |
| *3 Limiting gross | 40 | 40 | 18 | 30 | 40 | 45 | 40 | 28 | 15 | 20 |

TABLE 1-continued

| Embodiment<br>Kinds of metal sheet | 1<br>Thickness 0.18 mm TFS | | | | | | | | | |
|---|---|---|---|---|---|---|---|---|---|---|
| reduction ratio (%) | | | | | | | | | | |
| Damaging of organic film | 0 | 0 | (0) | 0 | X | 0 | 0 | (0) | (X) | (Δ) |
| *4 Neck-in Workability | 0 | X | 0 | 0 | X | 0 | 0 | 0 | 0 | 0 |
| *5 Classification | Ex. | Ref. | Ref. | Ref. | Ref. | Ex. | Ex. | Ex. | Ref. | Ref. |

Remarks:
*1 Contact between surface 10, 11 and can wall 14
*2 Limiting ironing ratio (%) = ($T_2$ − formable minimum thickness $T_3$) × 100/$T_2$
*3 Limiting gross thinning ratio (%) = ($_0$ − formable minimum thickness $T_3$) × 100/$T_0$
*4 Neck-in workability: formability of a drawn can to a limiting gross reduction ratio when the bore of its top end portion is reduced by 12% (evaluated with respect to wrinkles and cracks)
*5 Ex.: example of the present invention;
Ref.: comparative reference.
0: good
Δ: fair (problem for practical use)
X: bad
In case of "( )", the evaluation is done for the can at the limiting gross reduction ratio.
In case of no "( )", the evaluation is done for the can at the reduction of 30%.

TABLE 2

| Embodiment<br>Kinds of metal sheet | 2<br>Thickness 0.25 mm Aluminium alloy | | | | | | | |
|---|---|---|---|---|---|---|---|---|
| $R_1/T_0$ ratio | 5 | 5 | 5 | 5 | 5 | 5 | 10 | 5 |
| $R_2/T_0$ ratio | 2 | 2 | 2 | 1 | 2 | 2 | 17 | 5 |
| *1 Contact of can wall 14 | half | half | half | half | yes | no | no | no |
| $C_1/T_0$ ratio | 1.1 | 1.1 | 1.1 | 1.1 | 0.7 | 0.7 | 1.1 | 1.1 |
| Length L mm | 20 | 5 | — | 20 | 5 | 20 | 20 | 20 |
| Ironing | executed | executed | no | executed | executed | executed | executed | executed |
| *2 Limiting ironing ratio (%) | 30 | 30 | — | 8 | 30 | 35 | 35 | 35 |
| *3 Limiting gross reduction ratio (%) | 45 | 45 | 17 | 28 | 40 | 50 | 18 | 40 |
| Damaging of organic film | 0 | 0 | (0) | (0) | Δ | 0 | (Δ) | 0 |
| *4 Neck-in Workability | 0 | X | 0 | 0 | X | 0 | 0 | 0 |
| *5 Classification | Ex. | Ref. | Ref. | Ref. | Ref. | Ex. | Ref. | Ex. |

Remarks:
*1 Contact between surface 10, 11 and can wall 14
*2 Limiting ironing ratio (%) = ($T_2$ − - formable minimum thickness $T_3$) × 100/$T_2$
*3 Limiting gross thinning ratio (%) = ($T_0$ − formable minimum thickness $T_3$) × 100/$T_0$
*4 Neck-in workability: formability of a drawn can to a limiting gross reduction ratio when the bore of its top end portion is reduced by 12% (evaluated with respect to wrinkles and cracks)
*5 Ex.: example of the present invention;
Ref.: comparative reference.
0: good
Δ: fair (problem for practical use)
X: bad
In case of "( )", the evaluation is done for the can at the limiting gross reduction ratio.
In case of no "( )", the evaluation is done for the can at the reduction of 30%.

To summarise the advantages of at least the preferred embodiments of the present invention, not only is it possible for the diameter of the can shell to be reduced but it is also possible for the can wall to be thinned in a high thinning ratio without damaging the organic film on the inner and outer surfaces thereof. Moreover, it is possible for the can wall to remain thick at its top end portion, enabling the formation of a redrawn can suitable for subsequent neck-in processing.

At least in the illustrated embodiments of the present invention there is provided a can processing method for reducing the can diameter and wall thickness after it has been drawn from a metal sheet which has been previously coated with an organic film; furthermore, the wall thickness of such a can will be reduced in a high reduction ratio, while the top end portion of the can is thickened in readiness for subsequent neck-in processing. The processes of redrawing, stretching and ironing are accomplished at the same time.

I claim:

1. Method of redrawing a predrawn metal can coated with an organic film, said method comprising the steps of drawing a metal can from a metal blank coated with an organic film and having a thickness $T_0$ to form a predrawn can, said predrawn can having an inner surface, an outer surface, and a wall thickness $T_1$, holding said predrawn can between a blank holder having a shoulder of radius $R_1$ facing said inner surface and a redrawing die having a shoulder of radius $R_2$ facing said outer surface, redrawing said predrawn can by moving a punch through said redrawing die to produce a redrawn can having a wall thickness $T_2$, ironing said redrawn can by moving said punch through an ironing portion of an ironing die adjacent to and at a distance of 10 to 30 mm from the shoulder of said redrawing die to produce a redrawn and ironed can having a wall thickness $T_3$, the reduction ratio for the ironing die being defined by:

$$\frac{(T_2 - T_3)}{(T_2)} \times 100\%$$

said reduction ratio being in the range of 10 to 50%.

2. Method as in claim 1 wherein said redrawn can has an outer surface which is not in contact with said redrawing die or said ironing die between said shoulder of said redrawing die and said ironing portion of said ironing die.

3. Method as in claim 2 wherein said punch has an axis which is at an angle which is less than 7 degrees to a line from the shoulder of the redrawing die to the ironing portion of the ironing die.

4. Method as in claim 1 wherein said redrawing die is at a distance $C_1$ from said punch, where $C_1$ is 0.8 to 1.4 times $T_0$.

5. Method as in claim 1 wherein said radius $R_1$ is 4 to 20 times $T_0$ and the radius $R_2$ is 1.2 to 15 times $T_0$.

6. Method as in claim 5 wherein said radius $R_1$ is 4 to 10 times $T_0$ and said radius $R_2$ is 1.5 to 8 times $T_0$.

7. Method as in claim 2 wherein said outer surface is not in contact with said redrawing die or said ironing die for at least one third of the distance between said shoulder and said ironing portion.

8. Method as in claim 1 wherein said predrawn can has an organic coating on said inner surface and said outer surface prior to redrawing.

9. Method as in claim 1 wherein said can is redrawn and ironed without using any water based lubricant.

10. Apparatus for redrawing and ironing a predrawn metal can having an inner surface and an outer surface, said apparatus comprising a blank holder having a shoulder of radius $R_1$ for placing against said inner surface, a redrawing die adjacent to said blank holder and having a shoulder of radius $R_2$ for placing against said outer surface, an ironing die adjacent to said redrawing die and having an ironing portion defining a minimum inside radius of said ironing die, said ironing portion being at a distance of 10 to 30 mm from the shoulder of the redrawing die, and a punch movable through said redrawing die with a clearance $C_1$ to form a redrawn can of wall thickness $T_2$, and further movable through said ironing die with a clearance $C_2$ to form a redrawn and ironed can of thickness $T_3$, the reduction ratio of the ironing die being defined by:

$$\frac{(T_2 - T_3)}{2} \times 100\%$$

said reduction ratio being in the range of 10 to 50%.

* * * * *